US007744354B2

(12) United States Patent
Lilie

(10) Patent No.: US 7,744,354 B2
(45) Date of Patent: Jun. 29, 2010

(54) FLUID PUMP, A FLUID-TRANSFER PLATE AND AN INDUCTIVE SENSOR FOR A FLUID PUMP

(75) Inventor: Dietmar Erich Bernhard Lilie, Joinville-SC (BR)

(73) Assignee: Empresa Brasileira de Compressores S.A. —EMBRACO, Joinville —SC (BR)

( * ) Notice: Subject to any disclaimer, the term of this patent is extended or adjusted under 35 U.S.C. 154(b) by 845 days.

(21) Appl. No.: 10/527,395

(22) PCT Filed: Jul. 10, 2003

(86) PCT No.: PCT/BR03/00093

§ 371 (c)(1),
(2), (4) Date: Oct. 12, 2005

(87) PCT Pub. No.: WO2004/025120

PCT Pub. Date: Mar. 25, 2004

(65) Prior Publication Data

US 2006/0127249 A1 Jun. 15, 2006

(30) Foreign Application Priority Data

Sep. 12, 2002 (BR) ..... 0203724

(51) Int. Cl.
*F04B 17/00* (2006.01)

(52) U.S. Cl. ..... 417/415; 417/572; 73/168; 324/207.15; 324/207.22; 324/207.26

(58) Field of Classification Search ..... 417/417; 73/168; 324/207.15, 207.22, 207.24, 207.26
See application file for complete search history.

(56) References Cited

U.S. PATENT DOCUMENTS 4,471,304 A 9/1984 Wolf (Continued)

FOREIGN PATENT DOCUMENTS

DE 3221574 12/1983

(Continued)

OTHER PUBLICATIONS

International Search Report for International Appl. No. PCT/BR2003/000093 completed Sep. 22, 2003.

(Continued)

*Primary Examiner*—Charles G Freay
*Assistant Examiner*—Christopher Bobish
(74) *Attorney, Agent, or Firm*—Alston & Bird LLP

(57) ABSTRACT

The present invention relates to a fluid pump and a fluid-transfer plate and a sensor for a fluid pump, particularly applicable to linear compressors, for detecting the position of the respective piston and preventing the latter from colliding with the fluid-transfer plate upon variations in the compressor operation conditions, or even variations in the feed voltage. The objectives of the present invention are achieved by means of a fluid pump (1) comprising a piston (2) that is axially displaceable within a cylinder (3), the cylinder (3) comprising a cylinder closing fluid-transfer plate (40), the piston (2) being displaced toward the fluid-transfer plate (40) and capturing a gas or fluid from a low-pressure environment (11), and the fluid pump (11) comprising a sensor assembly (98), which includes an inductive sensor (8) associated with the fluid-transfer plate (40). The objectives of the present invention are also achieved by means of a fluid-transfer plate (40) particularly applicable to a fluid pump (1) and that comprises a valve plate (4) provided with a though-bore (10) for associating a protector (9) that cooperates with the cavity (10), the protector (9) comprising at least one sensor cavity (8') for associating an inductive sensor (8). An inductive sensor (8) is also foreseen, which is applicable to the fluid pump (1).

12 Claims, 3 Drawing Sheets

U.S. PATENT DOCUMENTS

| | | | | | |
|---|---|---|---|---|---|
| 4,474,537 | A | * | 10/1984 | Dolz | 417/44.1 |
| 4,662,177 | A | * | 5/1987 | David | 60/595 |
| 4,846,048 | A | * | 7/1989 | Hvilsted et al. | 92/5 R |
| 4,899,643 | A | * | 2/1990 | Hvilsted et al. | 92/5 R |
| 4,924,675 | A | | 5/1990 | Higham et al. | |
| 5,069,317 | A | | 12/1991 | Stoll et al. | |
| 5,455,509 | A | | 10/1995 | Semura et al. | |
| 6,084,320 | A | | 7/2000 | Morita et al. | |
| 6,663,348 | B2 | * | 12/2003 | Schwarz et al. | 417/12 |
| 6,779,984 | B2 | | 8/2004 | Lilie et al. | |

FOREIGN PATENT DOCUMENTS

| | | |
|---|---|---|
| DE | 3246731 | 6/1984 |
| DE | 4410363 | 9/1995 |
| EP | 0271878 | 6/1988 |
| EP | 0398012 | 11/1990 |

OTHER PUBLICATIONS

International Preliminary Examination Report for International Appl. No. PCT/BR2003/000093 completed Sep. 14, 2004.

* cited by examiner

FLUID PUMP, A FLUID-TRANSFER PLATE AND AN INDUCTIVE SENSOR FOR A FLUID PUMP

The present invention relates to a fluid pump, a fluid-transfer plate and a sensor for a fluid pump, particularly applicable to linear compressors, for detecting the position of the respective piston and preventing the latter from colliding with the fluid-transfer plate upon variations in the compressor operation conditions, or even variations in the feed voltage.

DESCRIPTION OF THE PRIOR ART

A linear compressor basically comprises an axially displaceable piston in a bored-through body, usually a cylinder, the function of the piston being to compress the gas used in the cooling cycle. The gas-compression mechanism takes place by virtue of the axial movement of the piston, suction and discharge valves being positioned at the end of the piston stroke, which adjust the inlet and outlet of the gas in the cylinder. The piston is actuated by an actuator, which is formed by a support and a magnet, which is actuated by a coil, this assembly being further actuated by a helical spring, forming a resonant assembly of the compressor.

The resonant assembly actuated by the linear motor has the function of developing a linear alternating movement, causing the movement of the piston inside the cylinder to exert a compression action on the gas admitted by the suction valve up to the point at which it may be discharged to the high-pressure side through the discharge valve.

Variations in the compressor operation conditions, or even variations in the feed voltage, may cause the resonant assembly to be displaced more than necessary, thus leading the piston to collide at the end of its stroke, which causes noises and even damages to the compressor. Therefore, a means of controlling the piston movement is necessary.

Various solutions for controlling the piston movement have already been proposed, such as that disclosed in document EP 0 398 012, which describes a sensor locate at the end of the stroke of an actuator piston. Such an actuator is built from a disc manufactured with a conducting material in order to enable one to determine the distance between the piston and the end of the stroke of the cylinder by means of a magnetic sensor, in order to prevent collision of the piston at the end of the stroke of the cylinder. One of the drawbacks of this solution is that the positioning of the sensor as proposed causes it to be subject to the inner pressure of the cylinder, which results in troubles with the tightness of the equipment, besides complications in the electric connections of the sensor, since the latter is subjected to high-compression areas, and this may cause malfunction thereof as time passes.

Another solution of the prior art is disclosed in document U.S. Pat. No. 4,924,675, which describes a linear compressor provided with a magnetic sensor that detects the position of the piston in its stroke by means of the magnetic flow created between the sensor and a magnet existing in the piston. The positioning of the sensor in the external structure of the piston stroke in the cylinder causes this existing wall between the sensor and the piston to be an obstacle for the passage of the magnetic flow that is necessary to detect the piston stroke.

A further solution of the prior art is described in document DE 3246731, which discloses a sensor positioned at the end of the piston stroke, but protuberant with respect to the cylinder structure. With this construction, the piston may collide at the end of its stroke, and the position sensor may be broken or damaged.

Another solution of the prior art is described in document U.S. Pat. No. 6,084,320, which discloses a position sensor positioned at the beginning of the piston stroke and fixed to the piston body. Since in this solution, the sensor moves together with the piston, the possibility of the latter suffering damages due to this movement is great, for which reason this configuration is litter reliable, besides bringing complications while assembling the equipment.

Further solutions are described, for example, in documents U.S. Pat. No. 4,471,304, U.S. Pat. No. 5,455,509 and EP 0 271 878, which disclose the position of the sensor for detecting the piston stroke at the side of the cylinder and without adequate protection for them. The drawback in these cases is the need to provide a magnetic layer on the piston for detecting its position, which limits the use of piston types in these configurations.

A problem that exists in the prior art is the fact that a sensor provided on a compressor is subjected to varying pressures, which oscillate between the minimum pressure of the gas or fluid to be compressed and the maximum pressure of the gas or fluid compressed by the compressor. This pressure variation may cause tightness problems to the compressor: (i) since the compressed gas or fluid may leak at the place of positioning the sensor, and (ii) to the monitoring circuit of movement of the compressor piston, since the electric connections of the sensor may be impaired by the high pressures to which the regions where the gas or fluid is compressed by the piston are subjected.

Other approaches to the problem are described, for instance, in document PI 0001404, which discloses a piston-detecting sensor that prevents collision thereof with the cylinder head, provided with an electric probe cooperating with the control circuit. In this case, the detection of the proximity of the piston to its stroke end is effected by electric contact of the piston with the sensor. Although this solution meets the requirements and prevents impact of the piston, this solution using physical contact of the sensor with the piston may generate electric noise, which may interfere with the precision in measurement.

In the face of the drawbacks cited above, the present invention discloses improvements in the area of compressors provided with a piston-position sensor.

OBJECTIVES OF THE INVENTION

One of the objectives of the present invention is to provide a fluid pump, a fluid-transfer plate and an inductive sensor for a fluid pump, in such a configuration that it will enable one to indicate the position of the piston inside a linear compressor.

Another objective of the present invention is to provide an insulating protector for the piston-position inductive sensor of a linear compressor.

A further objective of the present invention is to provide a piston-position sensor at a location that is subjected to the high pressures of the compressor and that will not suffer mechanical interference between the piston and the sensor, by virtue of the isolation of the inductive sensor from the high-pressure environment.

A further objective of the present invention is to provide a sensor that is inexpensive to manufacture and to implement and, at the same time, has the desired reliability on this type of equipment and that does not have the drawbacks of the solutions of the prior art.

BRIEF DESCRIPTION OF THE INVENTION

The objectives of the present invention are achieved by means of a fluid pump comprising a piston that is axially displaceable within a cylinder, the cylinder comprising a cylinder closing fluid-transfer plate, the piston being displaced towards the fluid-transfer plate and capturing gas or is fluid from a low-pressure environment, and the fluid pump being characterized in that it comprises a sensor assembly that includes an inductive sensor associated with the fluid-transfer plate, the fluid-transfer plate comprises a vale plate provided with a through-bore for association of a protector that cooperates with the bore, the sensor being positioned in contact with the low-pressure environment.

The objectives of the present invention are also achieved by means of a fluid-transfer plate, particularly applicable to a fluid pump and comprising a valve plate provided with a through-bore for association with a protector cooperating with the bore, the protector comprising at least one as sensor cavity for association with the inductive sensor.

The objectives of the present invention are also achieved by means of an inductive sensor for a fluid pump, particularly applicable for detecting the piston position, the piston being axially displaceable in a cylinder, the fluid pump comprising a valve plate, the inductive sensor being installed on a protector, the protector being fixed to a through-bore provided in the valve plate.

BRIEF DESCRIPTION OF THE DRAWINGS

The present invention will now be described in greater detail with reference to an embodiment represented in the drawings. The figures show.

DETAILED DESCRIPTION OF THE FIGURES

Figure 1:
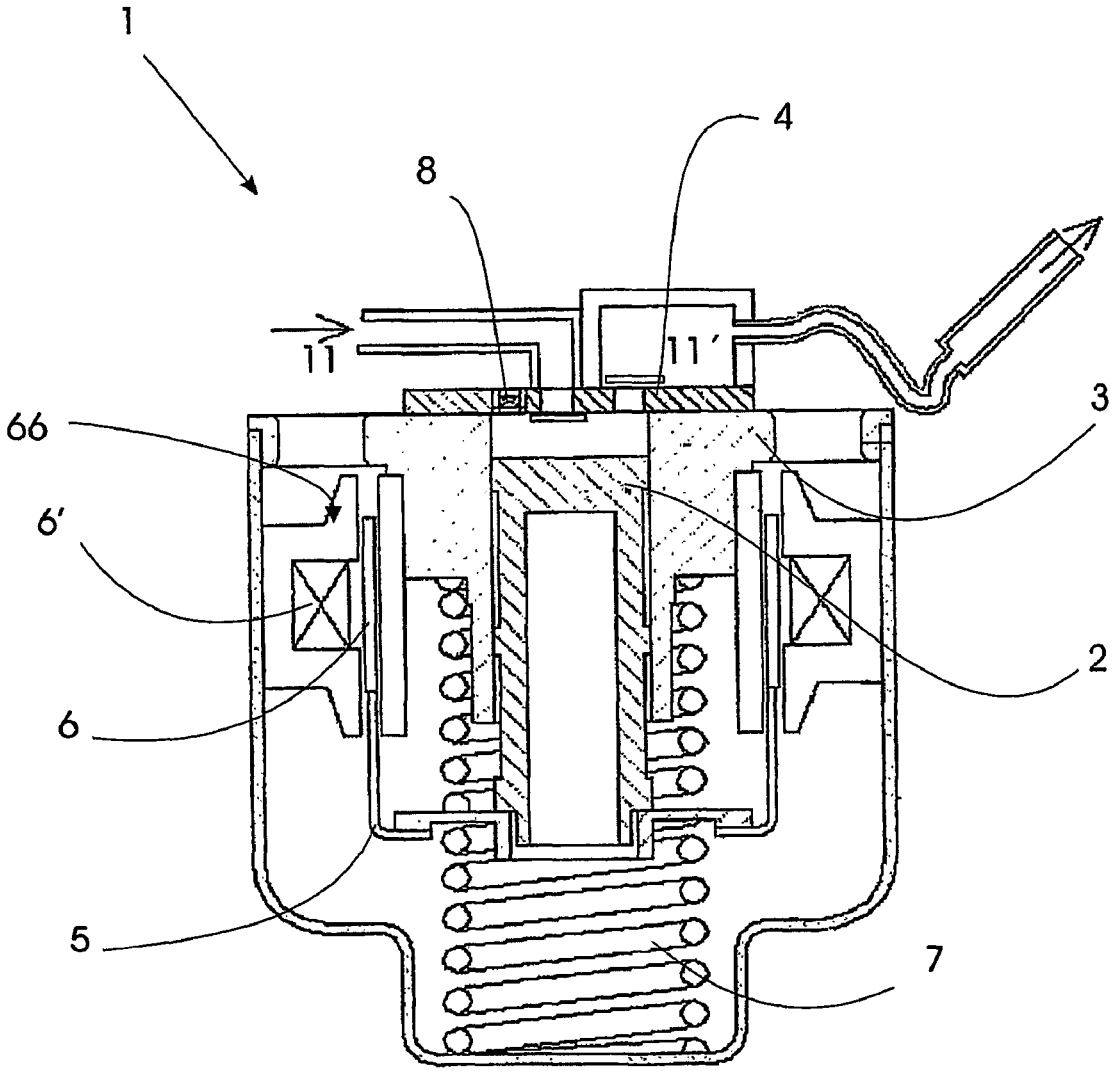
FIG. 1 is a cross-section view of a fluid pump comprising a sensor protector according to the object of the present invention.
Figure 2:
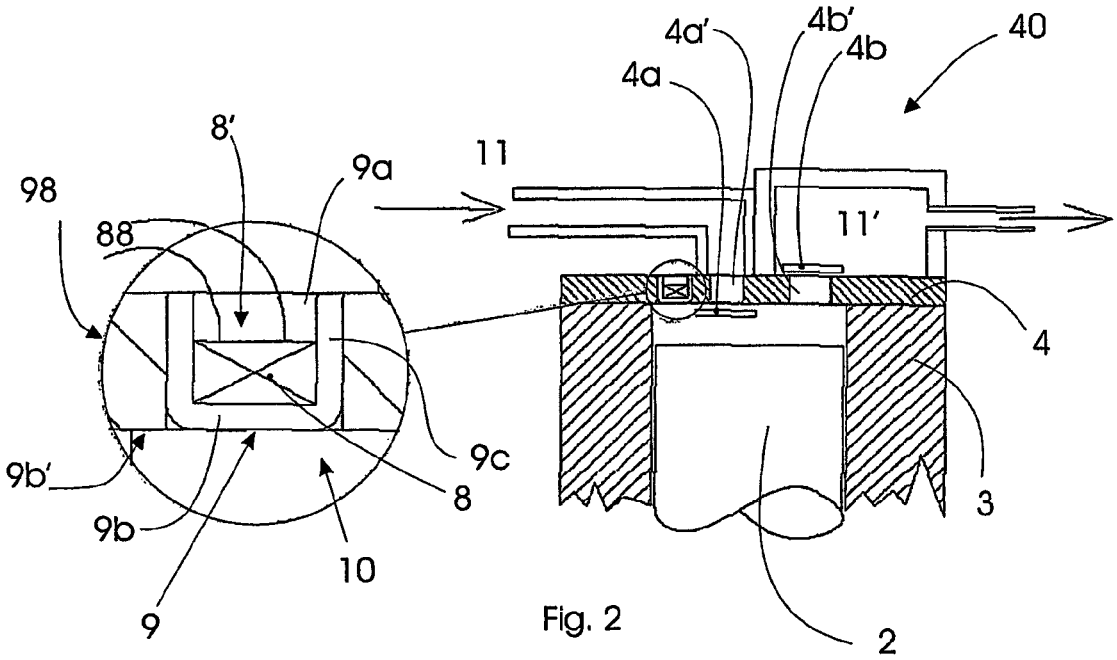
FIG. 2 is a cross-section view in detail of the position-sensor protector according to the present invention.

As can be seen in FIGS. 1 and 2, a linear compressor 1 (or fluid pump 1) comprises a piston 2 that is axially displaceable within a is cylinder 3, the cylinder 3 being usually closed at one of its ends with a fluid-transfer plate 40, which in turn comprises a valve plate 4 and an assembly composed of suction valve 4*a* and discharge valve 4*b*, theses suction and discharge valve 4*b* being associated to the suction openings 4*a'* and 4*b'*, respectively, which are provided in the valve plate 4.

The compressor 1 is positioned in a low-pressure environment 11, filled with the gas or fluid that will be compressed by the compressor 1 by virtue of the axial movement of the piston 2 inside the cylinder 3 (or high-pressure environment 11', when the gas or fluid is compressed) by means of the suction valve 4*a* and discharge valve 4*b* positioned on the transfer plate 40, which regulate the inlet and outlet of gas or fluid in the cylinder 3. The piston 2 is moved by a motor 66 comprising a magnet 6 that is actuated by a coil 8', helical spring 7 being mounted against the piston 2, so that this spring will always be compressed and form a resonant circuit.

The resonant circuit accounts for the linear movement, causing the piston 2 to make the desired linear movement and consequently compress the gas or fluid from the low-pressure environment 11, which goes in through the suction valve 4*a*, until it can be discharged to the high-pressure environment side 11' through the discharge valve 4*b* and led, for instance, to a cooling circuit (not shown).

The operation amplitude of the piston 2 of the compressor 1 is adjusted with the balance of the power generated by the motor 66 and the power consumed by the mechanism in compressing the gas and other losses. In order to obtain the best performance of the compressor 1, it is necessary to operate at an amplitude at which the piston 2 goes as close as possible to the fluid-transfer plate 40. The operation amplitude of the piston 2 should be known with accuracy since, if there are any mistakes, the safety distance for preventing collision of the piston 2 with the fluid-transfer plate 40 will have to be longer. This collision may damage the compressor 1, depending upon its use and application. Moreover, it should be foreseen that, according to the compressor 1 model to which the present invention will be applied, the fluid-transfer plate 40 may be configured in different ways. In some models, the suction valve 4*a* projects between the valve plate 4 and the piston 2, as shown in FIG. 2. In this case, the impact will be against the suction valve 4*a*, and the impact force will be discharged onto the valve plate 4 in other manner than in projects of compressor wherein the impact will occur directly on the cited valve plate 4. In both cases, the impact will be discharged on the fluid-transfer plate 40, which comprises the valve plate 4 and the assembly of suction valve 4*a* and discharge valve 4*b*.

A few solutions to this problem have already been discussed in the prior art, but all of them have the already cited drawbacks.

According to a preferred embodiment of the present invention and as can be seen in FIGS. 1 and 2, in accordance with the teachings of the present invention related to the fluid pump, the fluid-transfer plate and the inductive sensor for fluid pumps, one foresees an inductive sensor 8 associated with a protector 9 that, in turn, is associated with the fluid-transfer plate 40, forming a sensor assembly 98. The inductive sensor we should be positioned so as to emit a magnetic field towards the piston 2, that that the later, when approaching, will interfere with said magnetic field. In this way, it will be possible to monitor the distance of the piston with respect to the fluid-transfer plate 40 by means of an electronic circuit (not shown, because it is not an object of the present invention).

In order to make the mounting of the sensor assembly 98 feasible, the fluid-transfer plate 40 should comprise a through-bore 10 for fitting the protector 9, which will isolate the low-pressure environment 11 from the high pressure that occurs inside the cylinder 3 when in phase of compression of the gas or fluid.

The protector 9, which is analogous in shape to the bore 10, should preferably be built in cylindrical shape, since thin facilitates the construction of the through-bore 10 and, consequently, the manufacture of the compressor 1, which may be manufactured more rapidly and with lower costs.

In this embodiment, the protector 9 has fitting portions 9*c*, an open portion 9*a* and a closed portion 9*b*, forming a substantially glass-shaped piece with a sensor cavity 8' for accommodating a magnetic sensor 8. Constructively, the protector 9 is associated in such a way, that the fitting portions 9*c* cooperate with the through-bore 10 by interference, that is to say, the dimensions of the protector 9 should be minimally larger than the through-bore 10, so that it will be firmly seated on the valve plate 4, thus preventing the leakage of gas or fluid out of the cylinder 3, since this gas or fluid—compressed inside the cylinder 3—may reach high pressures, for example, 30 bar above the pressure in the low-pressure environment 11.

The closed portion 9*b* will be aligned with the inner face 9*b'* of the valve plate 4 and, for this reason, will no invade the bore 10 of the cylinder 3. This will prevent the problems of impact of the sensor with the piston 2, thus solving the problems of noise measurement of the prior art. At the same time, this configuration allows the inductive sensor 8 to be positioned exactly at the point necessary to prevent collision of the piston 2, since the interpretation of the value of the magnitude measured on the inductive sensor 8 will be directly proportional to the distance of the piston 2 from the valve plate 4, which facilitate the electronic monitoring of the compressor 1.

The open portion 9*a* will leave be sensor cavity 8' exposed to the low-pressure environment 11, where the inductive sensor 8 is positioned and fixed preferably against the closed portion 9*b* of the protector 9 for detecting the distance, and positioned preferably at the end of the piston 2 stroke. As a material for making the protector 9, one should employ a material that will not block the magnetic flow of the sensor 8 too much, for example, stainless steel. Evidently, other compatible metallic materials or even polymeric materials may be employed, as long as they meet the mechanical and electric requirements.

With this embodiment, one achieves the objective of keeping the sensor 8 protected from the high-pressure environment 11, besides permitting passage of the electric connections 88 to an electronic circuit (not show) far coding and interpreting the signals extracted from the sensor 1. Further, since the open portion 9*a* is positioned in the low-pressure environment 11, there will be no interference with the electric connections 88, which might be affected by the constant fluctuation of pressure. Another evident advantage resulting from the protector of the present invention is that the access to the electric connections 88 will be facilitated.

Anther advantage resuming from the present invention lies in the fact that the inductive sensor 8 cooperates directly with the material that constitutes the piston 2, and it is not necessary for the piston 2 to have a specific magnetic layer for working with the sensor 8. The latter should be constituted by a material that interferes with the magnetic field of the sensor 8, as for example, cast iron, aluminum, copper, etc.

The bore 10 and the protector 9 may be foreseen at any other point of the cylinder 3, or even in any other configuration of the compressor. Likewise, the position of the sensor 8 within the protector 9 may have any constructive configuration.

Figure 3:
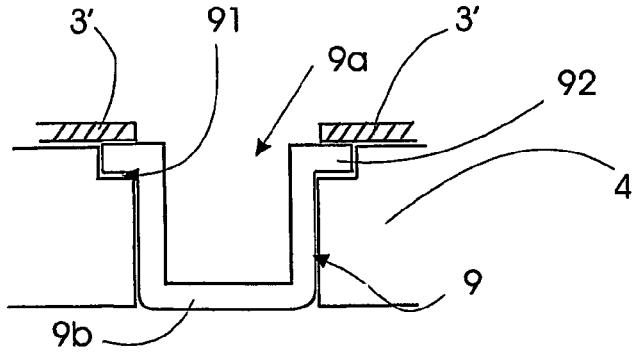
FIG. 3 is a second embodiment of the protector object of the present invention.

Further as can be seen in FIG. 3, according to a preferred embodiment of the present invention, the protector 9 may be fixed between a sealing joint 3' (usually present on compressors) and the proper valve plate 4. In this case, it may be not necessary to make a strict control over dimension tolerances of the protector 9 and of the through-bore 10. In this embodiment, the valve plate 4 may still comprise recesses 91 for fixing protuberant ends 92, preferably foreseen on the protector 9.

Figure 4:
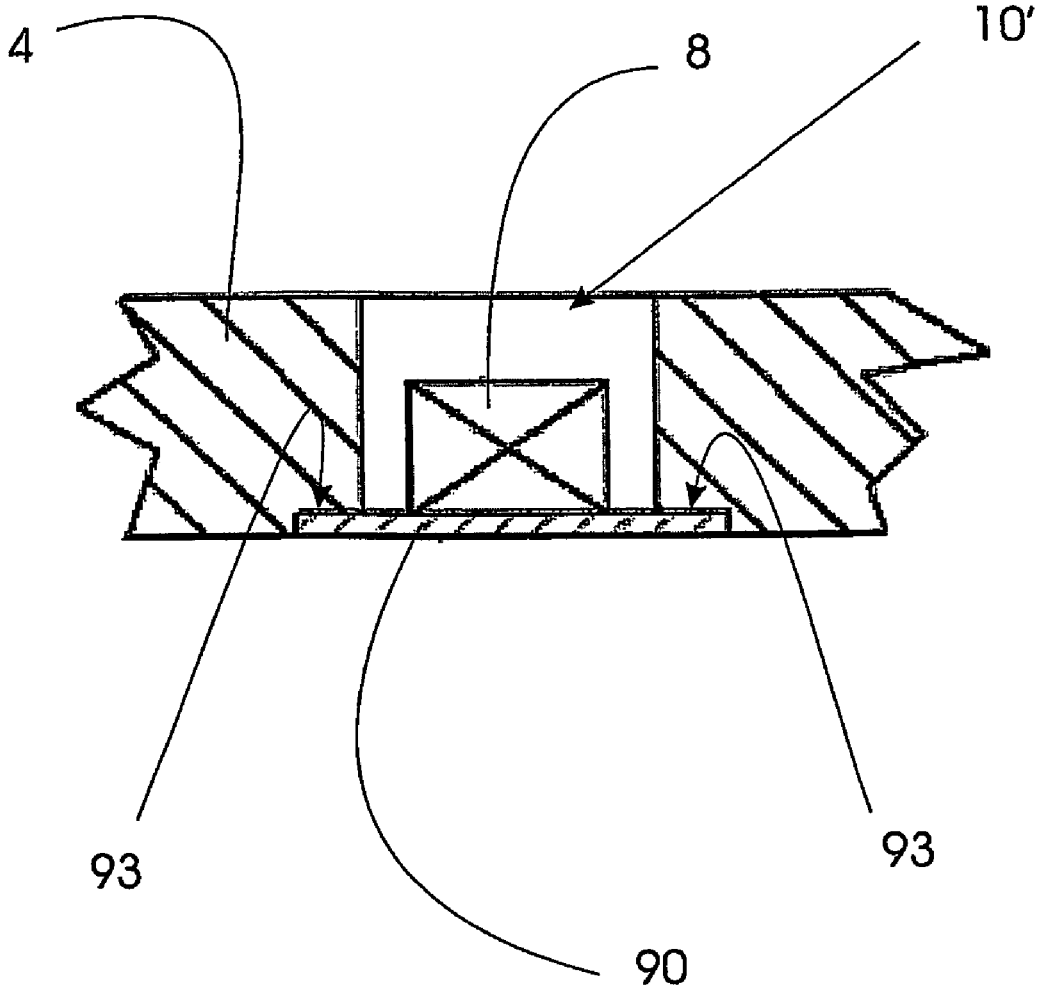
FIG. 4 is a cross-section view of a third preferred embodiment of the protector object of the present invention.

FIG. 4 shows another preferred embodiment of the present invention. In this case, the through-bore 10 of the valve plate 4 is closed by a protecting disc 90 instead of the protector 9.

In this embodiment, with the through-bore 10 being closed, a cavity 10' is formed. In this case, the fixation of the protecting disc 90 is effected in recesses 93 configured proportionally to the disc 90, these recesses 93 being provided on the inner face of the cylinder 3. In this case, the sensor 8 will be fixed to the back wall of the protecting disc 90.

Examples of preferred embodiment having been described, one should understand that the scope of the present invention embraces other possible variations, being limited only by the contents of the accompanying claims, which include the possible equivalents.

The invention claimed is:

1. A fluid pump comprising:

a piston that is axially displaceable within a cylinder;

the cylinder comprising a cylinder closing fluid-transfer plate;

the piston being displaced towards the fluid-transfer plate and capturing gas or fluid from a low-pressure environment;

the fluid pump comprising a sensor assembly that includes an inductive sensor associated with the fluid-transfer plate, the fluid-transfer plate being provided with a sealing joint structure;

the fluid-transfer plate comprising a valve plate provided with a through-bore for association of a protector that cooperates with the bore, the sensor being positioned in contact with the low-pressure environment, the valve plate further defining a recess in contact with the low-pressure environment and extending radially outwardly from the through-bore, and the sealing joint structure being disposed adjacent a surface of the valve plate in contact with the low-pressure environment and defining a generally planar portion overlying the recess in the valve plate; and at least a portion of the protector being fixed between the generally planar portion of the sealing joint structure and the recess defined in the valve plate.

2. A fluid pump according to claim 1, wherein the protector comprises at least one sensor cavity for associating the inductive sensor.

3. A fluid pump according to claim 2, wherein the inductive sensor emits a magnetic field in the direction of the piston.

4. A fluid pump according to claim 3, wherein the protector comprises a fitting portion, an open portion, and a closed portion, the fitting portion being cooperatively associated with the bore, the closed portion aligning with the inner face of the cylinder, and the open portion comprising the sensor cavity.

5. A fluid pump according to claim 4, wherein the valve plate comprises a suction valve associated with a low-pressure environment and a discharge valve associated with a high-pressure environment, and still in that the open portion is in contact with the low-pressure environment and the closed portion is in contact with the high-pressure environment.

6. A fluid pump according to claim 5, wherein the protector has substantially the same shape as the cavity.

7. A fluid pump according to claim 1, wherein the protector is built with a material having low magnetic permeability.

8. A fluid pump according to claim 1, wherein the sensor is fixed to the closed portion of the protector.

9. A fluid-transfer plate applicable to a fluid pump, comprising:

a valve plate provided with a through-bore for association with a protector that cooperates with the bore, the protector comprising at least one sensor cavity configured for receiving an inductive sensor therein, and the valve plate comprising recesses for fixing the protector, the protector comprising protuberant ends and being fixed to the valve plate by means of a sealing joint structure, the protuberant ends being associable with the recesses in the valve plate and a generally planar portion of the sealing joint structure, the sealing joint structure being disposed adjacent the valve plate, wherein at least a portion of the protuberant ends are disposed between the recesses in the valve plate and the generally planar portion of the sealing joint structure.

10. A fluid-transfer plate according to claim 9, wherein the protector comprises a fitting portion, an open portion and a closed portion, the fitting portion being cooperatively associated with the bore, the closed portion aligning with an inner face of the cylinder, and the open portion comprising the sensor cavity.

11. An inductive sensor and fluid pump assembly, the assembly comprising:

the inductive sensor for detecting the position of a piston in the fluid pump, the piston being axially displaceable in a cylinder, and the fluid pump comprising a fluid-transfer plate, the fluid-transfer plate comprising a valve plate, the inductive sensor being installed on a protector, the protector being fixed to a through-bore provided in the valve plate, the valve plate comprising recesses for fixing the protector, the protector comprising protuberant ends configured such that outer surfaces of the protuberant ends are aligned with an outer surface of the valve plate and at least a portion of the protuberant ends are disposed between the recesses and a generally planar portion of a surface of a sealing joint structure that is disposed adjacent the outer surface of the valve plate.

12. A fluid pump according to claim 1, wherein the valve plate comprises recesses for fixing the protector, the protector comprising protuberant ends configured such that a surface of the protector is aligned with a surface of the valve plate at the low-pressure environment, the sealing joint structure being configured such that edges of the sealing joint structure are placed substantially over the protuberant ends.

* * * * *

UNITED STATES PATENT AND TRADEMARK OFFICE

CERTIFICATE OF CORRECTION

PATENT NO. : 7,744,354 B2
APPLICATION NO. : 10/527395
DATED : June 29, 2010
INVENTOR(S) : Lilie It is certified that error appears in the above-identified patent and that said Letters Patent is hereby corrected as shown below:

Column 3

Line 7, “vale” should read --valve--

Column 4

Line 37, “we” should read --8--

Line 38, “later” should read --latter--

Line 51, “thin” should read --this--

Column 5

Line 2, “no” should read --not--

Line 11, “facilitate” should read --facilitates--

Line 12, “be” should read --the--

Line 27, “far” should read --for--

Line 35, “Anther” should read --Another--

Line 35, “resuming” should read --resulting--

Line 64, “embodiment” should read --embodiments--

Signed and Sealed this
Twenty-first Day of June, 2011

David J. Kappos

David J. Kappos
*Director of the United States Patent and Trademark Office*